US009797137B2

(12) United States Patent
Liu

(10) Patent No.: US 9,797,137 B2
(45) Date of Patent: Oct. 24, 2017

(54) FULLY ASSEMBLED, FULLY CAST-IN-PLACE, COMPOSITE-TYPE HOUSE AND CONSTRUCTION METHOD THEREOF

(71) Applicant: Kunshan Ecological Building Technology Co., Ltd., Jiangsu (CN)

(72) Inventor: Chun Liu, Shandong (CN)

(73) Assignee: Kunshan Ecological Building Technology Co., Ltd., Jiangsu (CN)

( * ) Notice: Subject to any disclaimer, the term of this patent is extended or adjusted under 35 U.S.C. 154(b) by 0 days.

(21) Appl. No.: 14/654,334

(22) PCT Filed: Sep. 5, 2013

(86) PCT No.: PCT/CN2013/082979

§ 371 (c)(1),
(2) Date: Jun. 19, 2015

(87) PCT Pub. No.: WO2014/094458

PCT Pub. Date: Jun. 26, 2014

(65) Prior Publication Data

US 2015/0330075 A1 Nov. 19, 2015

(30) Foreign Application Priority Data

Dec. 21, 2012 (CN) ..... 2012 1 0563521

(51) Int. Cl.
*E04C 3/294* (2006.01)
*E04B 5/29* (2006.01)
(Continued)

(52) U.S. Cl.
CPC ..... *E04C 3/294* (2013.01); *E04B 1/161* (2013.01); *E04B 5/29* (2013.01); *E04C 5/0618* (2013.01);
(Continued)

(58) Field of Classification Search
CPC ..... E04C 3/294; E04C 5/06; E04C 5/0618; E04C 5/065; E04C 5/04; E04B 1/161;
(Continued)

(56) References Cited

U.S. PATENT DOCUMENTS 6,871,462 B2 * 3/2005 Azizinamini ..... E01D 19/125 52/333
7,624,550 B2 * 12/2009 Ospina ..... E04B 1/161 52/262
(Continued)

FOREIGN PATENT DOCUMENTS

CN 85102407 1/1987
CN 1823203 8/2006
(Continued)

OTHER PUBLICATIONS

English translation of Search Report and Office action for related Chinese application 201210563521.9 retrieved from SIPO on Jun. 17, 2016 (6 pages).*
(Continued)

*Primary Examiner* — Rodney Mintz
(74) *Attorney, Agent, or Firm* — Bond Schoeneck & King, PLLC; George McGuire

(57) ABSTRACT

Disclosed are a fully assembled, fully cast-in-place, composite-type house and a construction method thereof, comprising providing at least one layer of house main body on a house foundation, wherein each layer of the house main body comprises: a tension bearing system which constitutes a wall body (1) or floor slab (2), a stabilizing function system for the tension bearing system, a system which constitutes a heat-insulating layer and a fire-proofing layer and is used as a formwork and has the function of supporting, and a pressure bearing system which connects together the aforementioned systems by means of a fully cast-in-place technique. The fully assembled, fully cast-in-place, composite-type house and the construction method thereof integrate structural component specifications, the overall stability of the house is good, and energy-saving and environmental protection requirements are satisfied.

5 Claims, 6 Drawing Sheets

(51) Int. Cl.

| | |
|---|---|
| ***E04B 1/16*** | (2006.01) |
| ***E04H 1/12*** | (2006.01) |
| ***E04C 5/06*** | (2006.01) |
| *E04C 5/04* | (2006.01) |
| *E04C 5/065* | (2006.01) |
| *E04B 2/86* | (2006.01) |
| *E04B 5/21* | (2006.01) |
| *E04C 3/08* | (2006.01) |

(52) U.S. Cl.
CPC ..... *E04H 1/12* (2013.01); *E04B 2/8647* (2013.01); *E04B 5/21* (2013.01); *E04C 3/08* (2013.01); *E04C 5/04* (2013.01); *E04C 5/065* (2013.01)

(58) Field of Classification Search
CPC ... E04B 5/29; E04B 1/165; E04H 1/00; E04H 1/12; E04G 21/00
See application file for complete search history.

(56) References Cited

U.S. PATENT DOCUMENTS

| | | | | |
|---|---|---|---|---|
| 2003/0115815 | A1 | 6/2003 | Azizinamini | |
| 2005/0284093 | A1* | 12/2005 | Foucher | E04B 1/0023 52/782.1 |
| 2011/0061315 | A1* | 3/2011 | Kisanakis | E02D 27/34 52/167.1 |
| 2012/0204510 | A1* | 8/2012 | Way | E04B 2/86 52/426 |
| 2014/0096455 | A1* | 4/2014 | Rogula | E04B 1/32 52/80.1 |
| 2015/0145156 | A1* | 5/2015 | Liu | E04G 11/38 264/35 |
| 2015/0191922 | A1* | 7/2015 | Giat | E04B 1/161 264/31 |

FOREIGN PATENT DOCUMENTS

| | | | |
|---|---|---|---|
| CN | 101200977 | | 6/2008 |
| CN | 201241488 | | 5/2009 |
| CN | 201377121 | | 1/2010 |
| CN | 101956437 | A * | 1/2011 |
| CN | 103015747 | | 4/2013 |
| CN | 202969631 | | 6/2013 |
| JP | 2007332631 | A * | 12/2007 |

OTHER PUBLICATIONS

English translation of International Preliminary Report on Patentability for PCT/CN2013/082979 dated Jun. 23, 2015 (14 pages).*
Extended European search report and written opinion for EPO Application No. 13865174.0 dated Jul. 21, 2016 (9 pages).*
PCT Application No. PCT/CN2013/082979 International Search Report Dated Nov. 28, 2013.

* cited by examiner

FULLY ASSEMBLED, FULLY CAST-IN-PLACE, COMPOSITE-TYPE HOUSE AND CONSTRUCTION METHOD THEREOF

CROSS-REFERENCE TO RELATED APPLICATION

The present application is the U.S. National Stage filing of PCT Application No. PCT/CN2013/082979 filed on Sep. 5, 2013, which claims priority to Chinese patent application No. 201210563521.9 filed on Dec. 21, 2012, the entirety of each of which are hereby incorporated by reference.

TECHNICAL FIELD

The present invention relates to the field of buildings (e.g. housing) and construction technology, in particular to a fully assembled and integrally cast composite housing and a construction method thereof.

TECHNICAL BACKGROUND

Basic necessities of life constitute daily things dealt with by human beings, and a housing is essential for people's life happiness. With the progress of society, people become increasingly demanding for housing from initial demands for sheltering from wind and rain to nowadays demands for warmth, comfort, sound proof, fire resistance, as well as certain abilities against natural disasters such as an aseismic ability. With the rapid development of China, continuous improvements of people's living level place thermal insulation and energy saving on the agenda, but lots of requirements and construction result in that demands for natural resources are continuously increased and air pollution is getting severe, therefore there are more and more needs for material saving and environmentally friendly construction. In China, a slogan of factory, industrialization and intensivism of building construction has already been put forward, but the existing housing structures can hardly meet all the above requirements.

So far, low housing buildings, middle-height housing buildings and high housing buildings are generally constructed of reinforced-concrete frame structures, framed shear wall structures, steel column frame structures filled with concrete, and steel structures, which are adopted in the vast majority of the existing housing buildings. The construction process of these structures generally includes constructing a structure body, building partition wall, plastering internal wall, building an external thermal insulation layer, and decorating external wall. The construction process of these structures takes a long time, a lot of workers are required at site to conduct wet work, a large number of used templates need to be removed, and there is a fire risk in building the external thermal insulation layer, so that the demands for energy saving, environmental protection, material saving, and factory, industrialization and intensivism of building construction cannot be met.

SUMMARY OF THE INVENTION

In view of the defects in the prior art, the invention aims to provide a fully assembled and integrally cast composite housing and a construction method thereof, where the involved process is simple and may be easily implemented, the involved components comply with a uniform specification and hence have great generality and can be conveniently and quickly assembled, and the housing has good overall stability and good fire resistance, water resistance and sound proof performances, so that the demands for energy saving, environmental protection, material saving, and factory, industrialization and intensivism of building construction can be met.

In order to achieve the above purpose, the technical scheme of the invention is as follows.

A fully assembled and integrally cast composite housing includes at least one layer of housing body established on the housing foundation, and the housing body includes a wall 1, a floor 2, a door 3 and a window 4, where each story of the housing body is constructed of a tendon like system, a marrow like system, a skin like system and a bone like system, each of which includes one or more components.

The tendon like system is a network system for bearing a tension within the wall 1 and the floor 2, and the network system includes: vertical steel columns 5, horizontal steel columns 6, a steel mesh member 7, a first roof truss beam 8 and a second roof truss beam 9, where space in the wall 1 is reserved for the installation of the door 3 and the window 4.

The marrow like system is configured to fix the network system bearing the tension within the wall 1 and floor 2 and connect the components in the tendon like system and the skin like system, and include a connecting piece 11, a fastener for the connecting piece 14 and a roof bottom die 19.

The skin like system, which includes wall panels 20, forms an external thermal insulation layer and an inner fire resistance layer for the wall 1, and functions as a casting plate and support system in connecting the tendon like system, the marrow like system and the skin like system together through the bone like system by the one-time cast molding process.

The bone system forms a bearing system in the wall 1 and the floor 2, is constructed by the one-time cast molding of the wall 1 and the floor 2 with high-strength self-compacting fluid mortar by an integrally casting process, and is configured to connect the tendon like system, the marrow like system and the skin like system together, to form a load bearing layer having a steel mesh member and cement composite multilayer structure.

Based on the above technical scheme, the high-strength self-compacting fluid mortar meets the following parameters that:

the slump is more than 28 cm, and decays to zero in about 1 hour, fluidity is maintained for 20 to 25 minutes, initial setting time is 1.5 hours, and the strength may be selected from 30 MPa, 35 MPa, 40 Mpa, and 45 MPa depending on the sequence number of a story in the housing.

Based on the above technical scheme, the connecting piece 11 and the wall panel 20 are foam concrete blocks, which are formed of cement (which acts as base material) added with fly ash, and are light building material modules.

Based on the above technical scheme, the network system for bearing tension in the wall 1 includes: a steel truss constructed by connecting the vertical steel columns 5 with the horizontal steel columns 6, where the vertical steel column 5 acts as a support column of the wall 1, and the horizontal steel column 6 acts as a ground beam or upper ring beam.

A distance between axes of adjacent vertical steel columns 5 is in a range from 15 cm to 60 cm.

The upper and lower ends of the vertical steel column 5 are respectively connected with the horizontal steel columns 6 acting as the upper ring beam and the ground beam through jointing steel bars.

The horizontal steel columns 6 acting as the ground beams are fixed to the housing foundation through the jointing steel bars.

To install a door or window, a reserved door installation area 33 or reserved window installation area 44 is formed by perpendicularly connecting the vertical steel columns 5 with the horizontal steel columns 6.

Steel mesh members 7 are fixed at both internal and external sides of the vertical steel columns 5 and both internal and external sides of the horizontal steel columns 6 through jointing steel bars The network system for bearing tension in the floor 2 includes: a number of parallel second roof truss beams 9, where the second roof truss beam 9 is provided with at least one opening 10 through which the first roof truss beam 8 passes through.

Several first roof truss beams 8 pass through the openings 10 in the second roof truss beams 9, and are perpendicularly connected with the second roof truss beams 9 to form a grid.

Based on the above technical scheme, after the first roof truss beams 8 are perpendicularly connected with the second roof truss beams 9 to form the grid, i.e. the network system for bearing tension in the floor 2, roof bottom dies 19 are fixed at the bottoms of the first roof truss beams 8 and the second roof truss beams 9 to form a roof cellular structure.

Based on the above technical scheme, the connecting piece 11 generally has a rectangular shape with chamfers 12 at its four corners, and at least four connecting through holes 13 are formed in the connecting piece 11.

The fastener 14 for the connecting piece generally has an elongated shape, and has a length same as the width of the vertical steel column 5. One of two opposite sides of the fastener 14 along its length direction is provided with a plurality of fixing steel bars 17, and the other one of the two opposite sides is provided with a slope 16 in the middle, where the slope 16 has a width matching with the width of the chamfer 12 on the connecting piece.

Every four fasteners 14 for the connecting piece are arranged in a rectangular shape on two adjacent vertical steel columns 5, and are fixed on the two adjacent vertical steel columns 5 according to the height of the connecting piece 11; each of the slopes 16 on the four fasteners 14 for the connecting piece is used for fixing one corner of the connecting piece 11, the chamfers 12 at the four corners of the connecting piece 11 are respectively in contact with the slopes 16 of the four fasteners 14 for the connecting piece and are limited by the slopes 16 and ends 15 of the fasteners 14 for the connecting piece, so that the connecting piece 11 is fixed on the vertical steel columns 5.

Based on the above technical scheme, at least four through holes 21 are formed in the wall panel 20.

The wall panels 20 are respectively arranged on the steel mesh members 7 at both the internal and external sides of the vertical steel columns 5 and the horizontal steel columns 6, and bolts are adopted to extend through the through holes 21 in the wall panels and the through holes 13 in the connecting pieces 11, so that the connecting pieces 11 and the wall panels 20 at both the internal and external sides of the connecting pieces 11 are connected together.

A construction method of a fully assembled and integrally cast composite housing includes the following steps:

Step 1: when a housing foundation has been built, horizontal steel columns 6 are arranged as ground beams along a direction of a wall, and are fixed to the housing foundation by jointing steel bars.

Step 2: vertical steel columns 5 are perpendicularly connected with the horizontal steel columns 6 arranged as the ground beams, where a distance between axes of adjacent vertical steel columns 5 is in a range from 15 cm to 60 cm.

Step 3: top ends of the vertical steel columns 5 are connected with horizontal steel columns 6 arranged as an upper ring beam through jointing steel bars, to form a steel truss.

To install a door or window, a reserved door installation area 33 or reserved window installation area 44 is formed by perpendicularly connecting the vertical steel columns 5 with the horizontal steel columns 6.

Step 4: each connecting piece 11 is assembled onto two adjacent vertical steel columns 5 through four fasteners 14 for the connecting piece in such a way that each of four corners of the connecting piece 11 is fixed to one of the four fasteners 14 for the connecting piece, except for in the reserved door installation area 33 and the reserved window installation area 44, until the connecting pieces 11 are installed in all space limited by the adjacent vertical steel columns 5 and the horizontal steel columns 6.

Step 5: steel mesh members 7 are respectively fixed on both internal and external sides of the vertical steel columns 5 and the horizontal steel columns 6 through jointing steel bars, resulting in a truss body formed by the steel mesh members 7, the vertical steel columns 5 and the horizontal steel columns 6.

Step 6: wall panels 20 are arranged on both the internal and external sides of the vertical steel columns 5 and the horizontal steel columns 6, and bolts are adopted to sequentially extend through the wall panel at one side, the connecting piece, and the wall panel at the other side to fix the same to the truss body together.

Step 7: the first roof truss beams 8 and the second roof truss beams 9 are perpendicularly connected to form a grid-shaped spatial truss, which is the network system for bearing tension in the floor 2.

Step 8: the roof bottom dies 19 are fixed at the bottoms of the first roof truss beams 8 and the second roof truss beams 9 to form a roof cellular structure.

Step 9: the seams of the housing (between the various components) are filled to prevent the leakage of the cast high-strength self-compacting fluid mortar.

Step 10: the wall 1 and the floor 2 are integrally cast by a one-time cast molding process, to connect the tendon like system, the narrow like system and the skin like system together, so that a bearing layer having a composite steel net cement multilayer structure is formed.

Based on the above technical scheme, specific steps of the integrally casting include: the high-strength self-compacting fluid mortar are transferred to corners of each room at the same floor through the main pipe and branch pipes for the purpose of simultaneous casting at different spots, to ensure that each wall at the whole floor of the building can be uniformly cast.

The speed of the integrally casting is controlled according to parameters including: the increased height of the cast mortar per hour that is no more than 30 cm, and it is ensured that the lateral pressure of the cast mortar during the casting is within an allowable safe range.

Based on the above technical scheme, in the case that the housing body includes two or more stories, before the arrangement of the wall panels 20 in step 6, vertical steel columns 5 for an upper story are fixed at the top of the vertical steel columns 5 for a lower story using jointing steel bars, and steps 2 to 5 are repeated to complete a steel truss for the upper story and the connections of fasteners 14 for the connecting piece and connecting pieces 11, subsequently steps 6 to 10 for the construction of the wall and floor for the lower story are performed.

In the fully assembled and integrally cast composite housing and the construction method thereof, the involved process is simple and may be easily implemented, the involved components comply with a uniform specification and hence have great generality and can be conveniently and quickly assembled, and the housing has good overall stability and good fire resistance, water resistance and sound proof performances, so that the demands for energy saving, environmental protection, material saving, and factory, industrialization and intensivism of building construction can be met.

DESCRIPTION OF DRAWINGS

The present invention is accompanied by the following drawings, in which.

DETAILED DESCRIPTION OF THE PREFERRED EMBODIMENT

Figure 1:
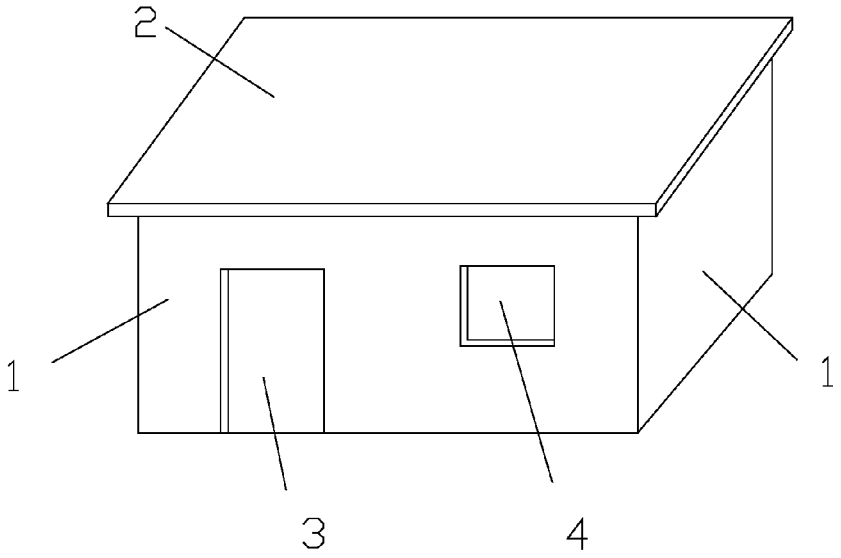
FIG. 1 shows an exemplary housing constructed by using a method of the invention.
Figure 2:
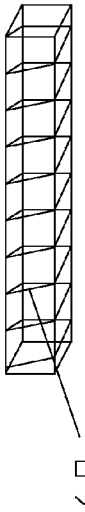
FIG. 2 is a schematic diagram showing a structure of a vertical steel column.
Figure 3:
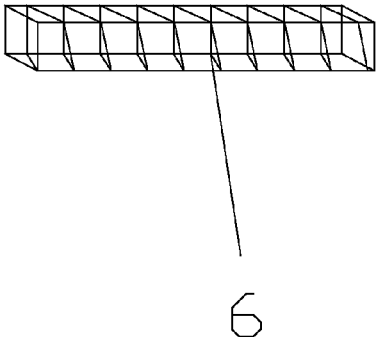
FIG. 3 is a schematic diagram showing a structure of a horizontal steel column.
Figure 4:
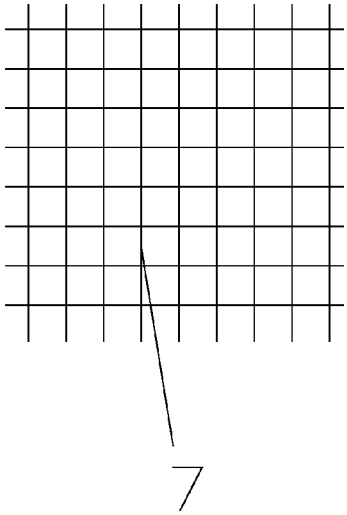
FIG. 4 is a schematic diagram showing a structure of a steel mesh member.

In combination with the accompanying drawings, the invention will be further illustrated in detail below.

The concept of the invention lies in that: each story of a housing body of a housing building located on a housing foundation is divided into four systems, including a tendon like system, a marrow like system, a skin like system, and a bone like system, as in a living body, and each of the four systems includes one or more components (e.g. standard components); after the assembling of the components of the tendon like system, the marrow like system and the skin like system at a story of the housing body is completed, mortar functioning as the bone like system is filled by a one-time cast molding process, to connect the components of the tendon like system, the marrow like system and the skin like system together to form a composite multilayer structure, thereby obtaining an integrally cast building which has an independent unit structure as well as fire resistance, thermal insulation, sound proof and aseismic functions, so that the weight of the building, the use of various auxiliary materials, the on-site construction processes, and the amount of labor and material can be reduced to the maximum extent, thus the building can meet the demands for energy saving, environmental protection, material saving, and factory, industrialization and intensivism of building construction. The housing foundation is conventional and can be established using the prior art, and hence will not be discussed more hereinafter.

As shown in FIGS. 1 to 10, the fully assembled and integrally cast composite housing includes at least one layer of housing body established on the housing foundation, and the housing body includes a wall 1, a floor 2, a door 3 and a window 4, where the wall 1 is configured to divide the housing body into at least one room, and the floor 2 is configured as an insulation layer between stories of the housing body or as a roof at the most top of the housing.

Each story of the housing body is constructed of a tendon like system, a marrow like system, a skin like system and a bone like system, each of which includes one or more components.

The tendon like system is a network system for bearing a tension within the wall 1 and the floor 2, and the network system includes: vertical steel columns 5, horizontal steel columns 6, a steel mesh member 7, a first roof truss beam 8 and a second roof truss beam 9, where space in the wall 1 is reserved for the installation of the door 3 and the window 4.

The marrow like system is configured to fix the network system bearing the tension within the wall 1 and floor 2 and connect the components in the tendon like system and the skin like system, and include a connecting piece 11, a fastener for the connecting piece 14 and a roof bottom die 19.

The skin like system, which includes wall panels 20, forms an external thermal insulation layer and an inner fire resistance layer for the wall 1, and functions as a casting plate and support system in connecting the tendon like system, the marrow like system and the skin like system together through the bone like system by the one-time cast molding process.

The bone like system forms a bearing system in the wall 1 and the floor 2, is constructed by the one-time cast molding of the wall 1 and the floor 2 with high-strength self-compacting fluid mortar by an integrally casting process, and is configured to connect the tendon like system, the marrow like system and the skin like system together, to form a load bearing layer having a steel mesh member and cement composite multilayer structure. The load bearing layer of the wall which constitutes the bone like system, has a thickness in a range from 2.5 cm to 4 cm, that is, a gap between the wall panels 20 arranged at both sides of the wall 1 is in a range from 2.5 cm to 4 cm, and the load bearing layer of the wall 1 is formed by casting the high-strength self-compacting mortar within the gap. The thickness of the floor 2 has a thickness in a range from 15 cm to 25 cm, and 1 inch is equal to 2.54 cm.

In the fully assembled and integrally cast composite housing, the wall 1 and the floor 2 are integrally cast at the same time, and hence are advantageous for good integrity, good aseismic performance, good elastic plastic mechanics characteristic, and high shear resistant capability. The housing has fire resistance, thermal insulation, sound proof and aseismic functions, where the skin like system has decoration, fire resistance and thermal insulation functions, and the marrow like system can enhance the internal sound proof effect. Further, additional casting plates and supports are not required for the assembling and integrally costing of the housing. The wall 1 can save more than 50% of concrete and lower the overall self-weight of the housing by 50%, compared with the conventional concrete shear wall.

Based on the above technical scheme, the high-strength self-compacting fluid mortar meets the following parameters that:

the slump is more than 28 cm, and decays to zero in 1 hour (±10 minutes), fluidity is maintained for 20 to 25 minutes, initial setting time is 1.5 hours, and the strength may be selected from 30 MPa, 35 MPa, 40 Mpa, and 45 MPa depending on the sequence number of a story in the housing.

Based on the above technical scheme, the vertical steel column 5 and the horizontal steel column 6 are hollow columns with spiral hooping which have a square cross section.

Based on the above technical scheme, the connecting piece 11 and the wall panel 20 are foam concrete blocks, which are formed of cement (which acts as base material) added with fly ash, and are light building material modules. The addition of the fly ash improves the fire resistant properties of the foam concrete blocks.

Based on the above technical scheme, the connecting piece 11 and the wall panel 20 have strengthened surfaces, to enable the ability to bear the side pressure caused by the casting of the high-strength self-compacting mortar when acting as the casting plate.

Figure 11:
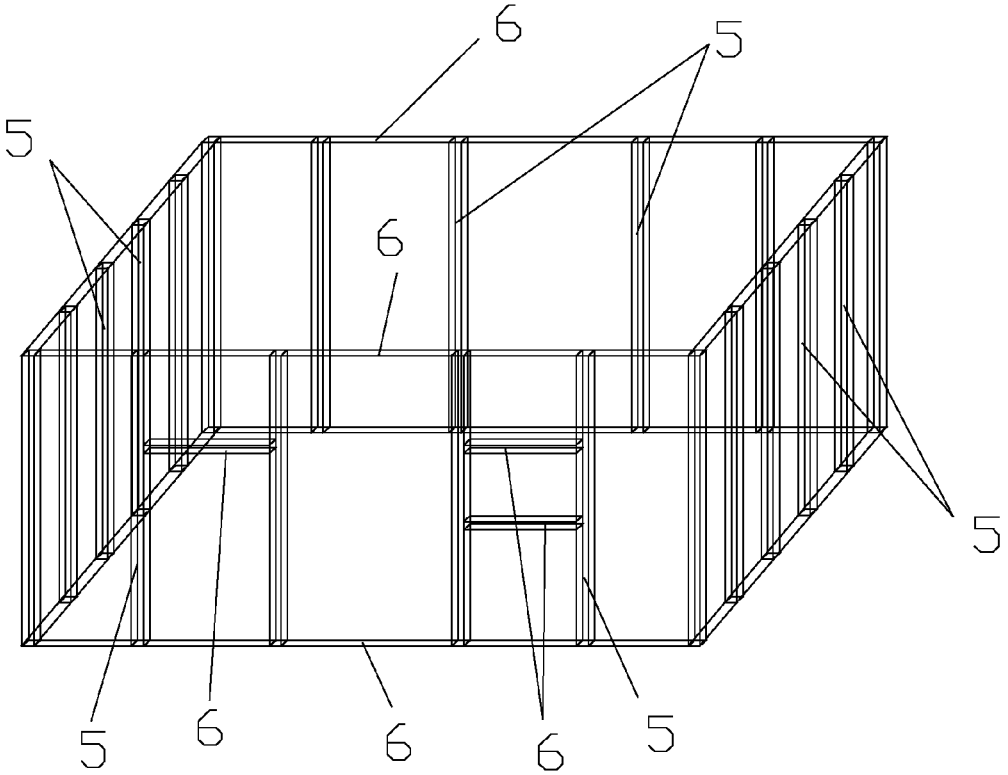
FIG. 11 shows a first construction process of the housing.
Figure 13:
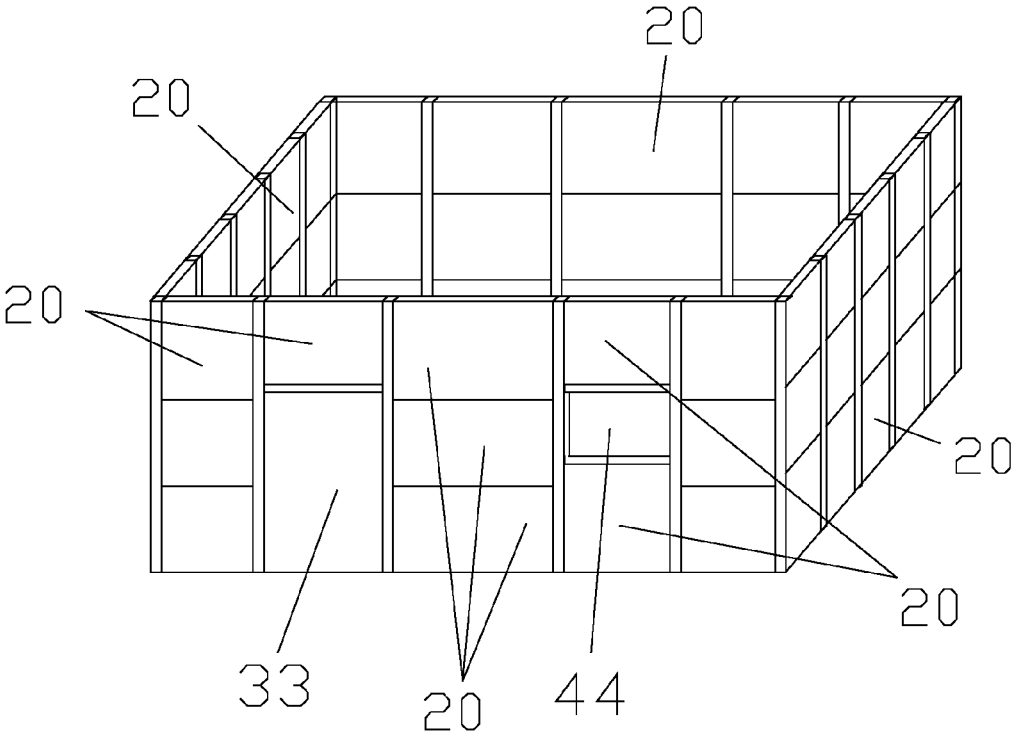
FIG. 13 shows a third construction process of the housing.

Based on the above technical scheme, as shown in FIGS. 11 and 13, the network system for bearing tension in the wall 1 includes: a steel truss constructed by connecting the vertical steel columns 5 with the horizontal steel columns 6, where the vertical steel column 5 acts as a support column of the wall 1, and the horizontal steel column 6 acts as a ground beam or upper ring beam.

A distance between axes of adjacent vertical steel columns 5 is in a range from 15 cm to 60 cm, for example, is 15 cm, 30 cm or 60 cm.

The upper and lower ends of the vertical steel column 5 are respectively connected with the horizontal steel columns 6 acting as the upper ring beam and the ground beam through jointing steel bars.

The horizontal steel columns 6 acting as the ground beams are fixed to the housing foundation through the jointing steel bars.

To install a door or window, a reserved door installation area 33 or reserved window installation area 44 is formed by perpendicularly connecting the vertical steel columns 5 with the horizontal steel columns 6.

Steel mesh members 7 are fixed at both internal and external sides of the vertical steel columns 5 and both internal and external sides of the horizontal steel columns 6 through jointing steel bars, and the internal and external sides respectively face the inside and outside of a room.

Figure 5:
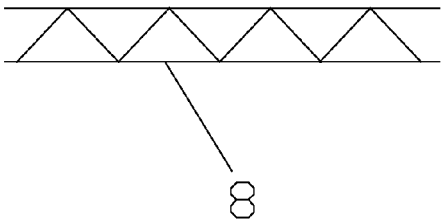
FIG. 5 is a schematic diagram showing a structure of a first roof truss beam.
Figure 6:
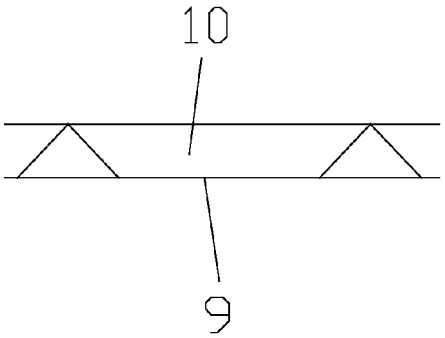
FIG. 6 is a schematic diagram showing a structure of a second roof truss beam.
Figure 14:
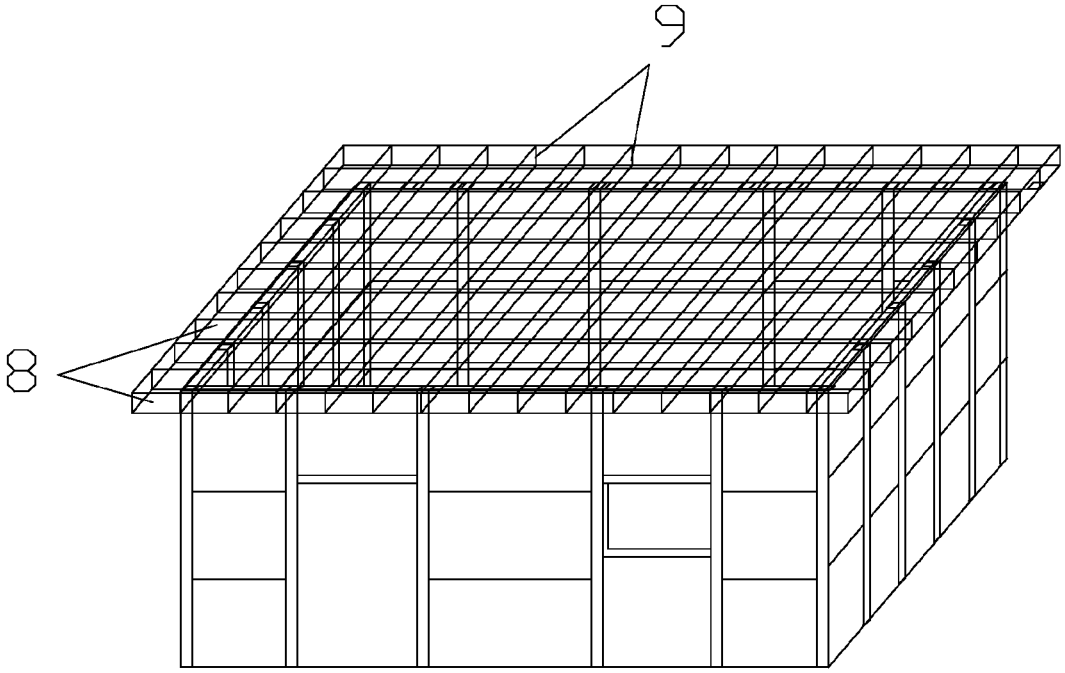
FIG. 14 shows a fourth construction process of the housing.

As shown in FIGS. 5, 6 and 14, the network system for bearing tension in the floor 2 includes: a number of parallel second roof truss beams 9, where the second roof truss beam 9 is provided with at least one opening 10 through which the first roof truss beam 8 passes through.

Several first roof truss beams 8 pass through the openings 10 in the second roof truss beams 9, and are perpendicularly connected with the second roof truss beams 9 to form a grid.

Figure 9:
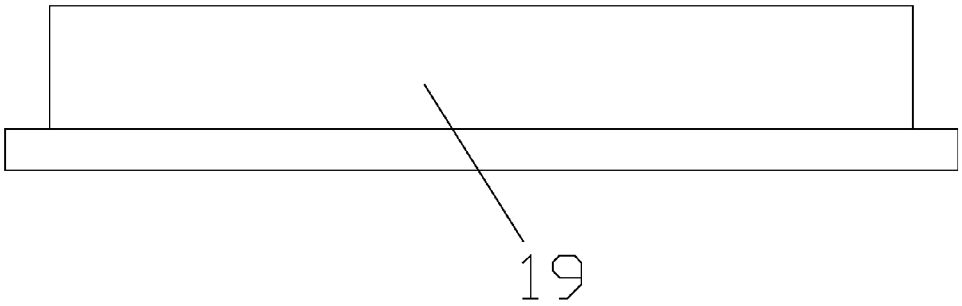
FIG. 9 is a schematic diagram showing a structure of a roof bottom die, FIG. 10 a schematic diagram showing a structure of a wall panel.
Figure 15:
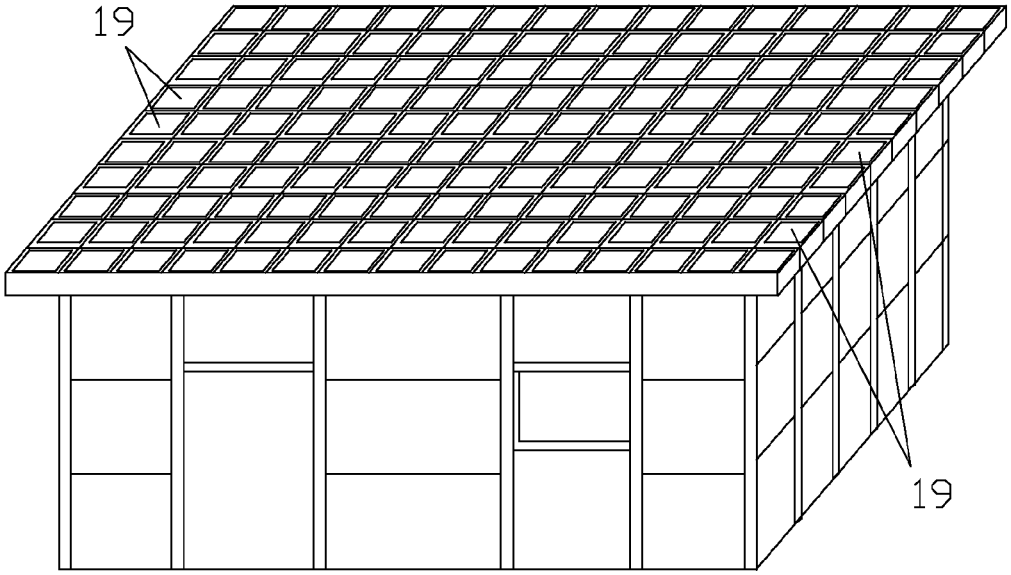
FIG. 15 show a fifth construction process of the housing.
Figure 16:
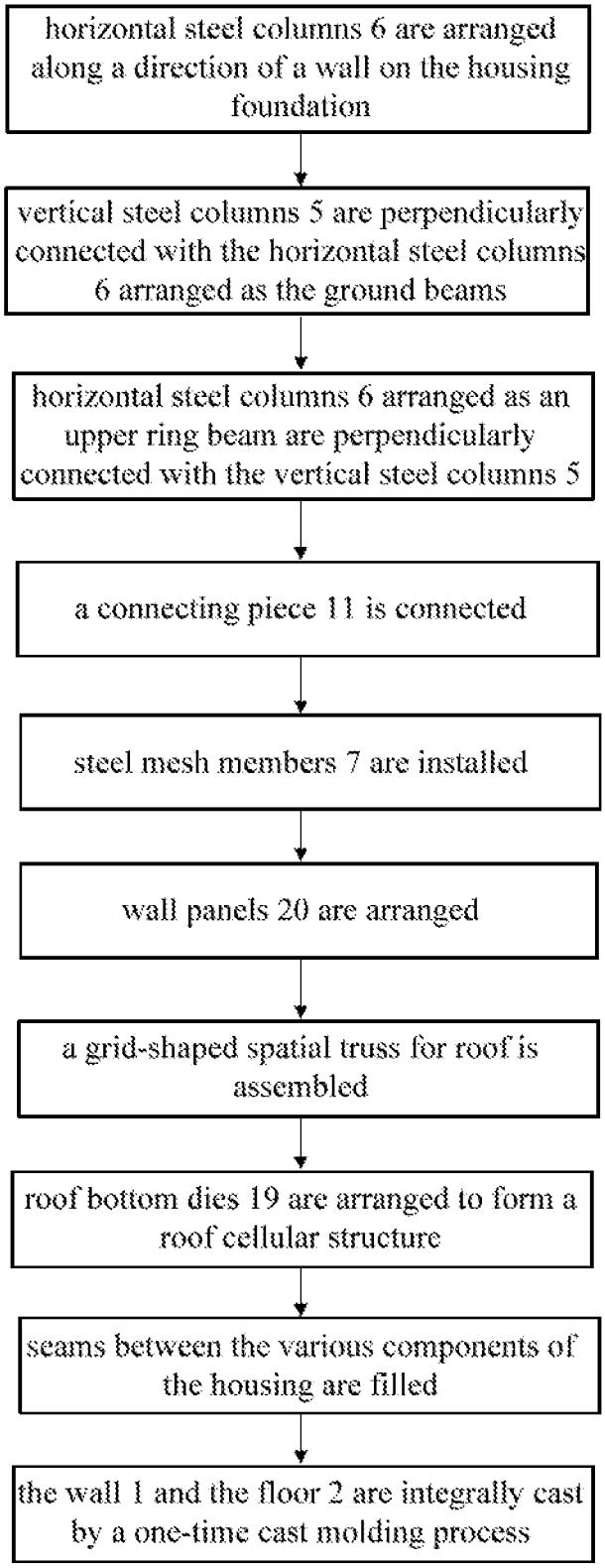
FIG. 16 a flow chart of a construction method for the housing.

Based on the above technical scheme, as shown in FIGS. 9 and 15, after the first roof truss beams 8 are perpendicularly connected with the second roof truss beams 9 to form the grid, i.e. the network system for bearing tension in the floor 2, roof bottom dies 19 are fixed at the bottoms of the first roof truss beams 8 and the second roof truss beams 9 to form a roof cellular structure.

Figure 7:
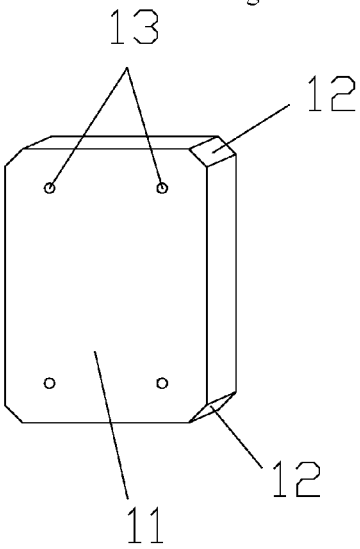
FIG. 7 is a schematic diagram showing a structure of a connecting piece.
Figure 8:
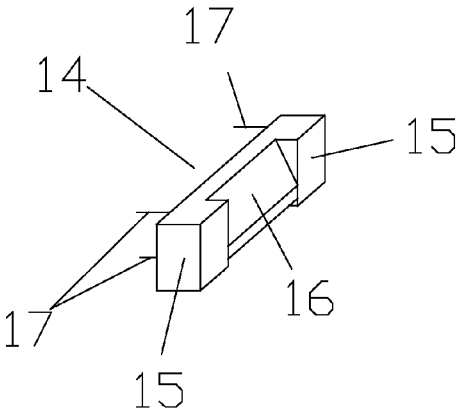
FIG. 8 is a schematic diagram showing a structure of a fastener for the connecting piece.
Figure 12:
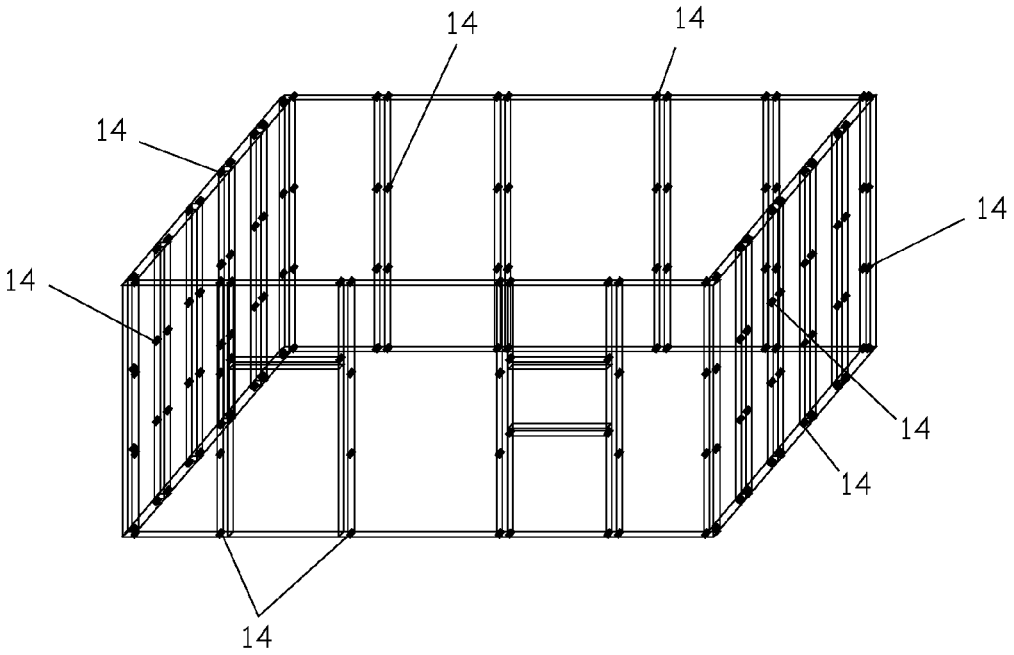
FIG. 12 shows a second construction process of the housing.

Based on the above technical scheme, as shown in FIGS. 7, 8 and 12, the connecting piece 11 generally has a rectangular shape with chamfers 12 at its four corners, and at least four connecting through holes 13 for receiving bolts are formed in the connecting piece 11.

The fastener 14 for the connecting piece generally has an elongated shape, and has a length same as the width of the vertical steel column 5. One of two opposite sides of the fastener 14 along its length direction is provided with a plurality of fixing steel bars 17, and the other one of the two opposite sides is provided with a slope 16 in the middle, where the slope 16 has a width matching with the width of the chamfer 12 on the connecting piece.

Every four fasteners 14 for the connecting piece are arranged in a rectangular shape on two adjacent vertical steel columns 5, and are fixed on the two adjacent vertical steel columns 5 according to the height of the connecting piece 11; each of the slopes 16 on the four fasteners 14 for the connecting piece is used for fixing one corner of the connecting piece 11, the chamfers 12 at the four corners of the connecting piece 11 are respectively in contact with the slopes 16 of the four fasteners 14 for the connecting piece and are limited by the slopes 16 and ends 15 of the fasteners 14 for the connecting piece, so that the connecting piece 11 is fixed on the vertical steel columns 5.

As such, not only the connecting piece 11 is fixed, but also the rigid of the vertical steel column 5 is improved. The connecting piece 11 is placed across the span between the adjacent vertical steel columns 5. Depending on the height of the connecting piece 11 and the height of the vertical steel column 5, one, two or more connecting pieces 11 may be arranged between two adjacent vertical steel columns 5.

Figure 10:
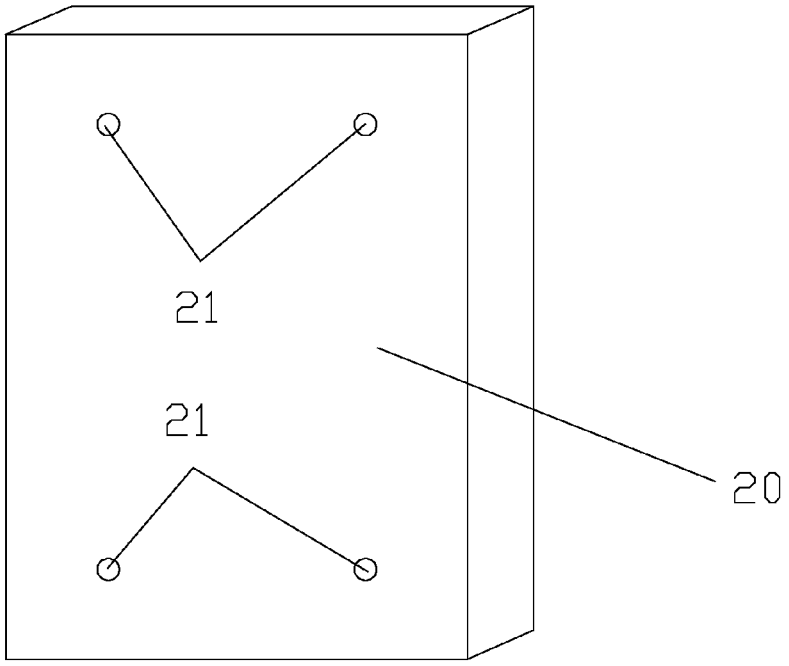

Based on the above technical scheme, as shown in FIGS. 10 and 13, at least four through holes 21 for receiving bolts are formed in the wall panel 20.

The wall panels 20 are respectively arranged on the steel mesh members 7 at both the internal and external sides of the vertical steel columns 5 and the horizontal steel columns 6, and bolts are adopted to extend through the through holes 21 in the wall panels and the through holes 13 in the connecting pieces 11, so that the connecting pieces 11 and the wall panels 20 at both the internal and external sides of the connecting pieces 11 are connected together.

The present invention also provides a construction method of a fully assembled and integrally cast composite housing, as shown in FIGS. 11 to 16, the construction method includes the following steps.

Step 1: when a housing foundation has been built, horizontal steel columns 6 are arranged as ground beams along a direction of a wall, and are fixed to the housing foundation by jointing steel bars.

Step 2: vertical steel columns 5 are perpendicularly connected with the horizontal steel columns 6 arranged as the ground beams, where a distance between axes of adjacent vertical steel columns 5 is in a range from 15 cm to 60 cm.

Step 3: top ends of the vertical steel columns 5 are connected with horizontal steel columns 6 arranged as an upper ring beam through jointing steel bars, to form a steel truss.

To install a door or window, a reserved door installation area 33 or reserved window installation area 44 is formed by perpendicularly connecting the vertical steel columns 5 with the horizontal steel columns 6.

Step 4: each connecting piece 11 is assembled onto two adjacent vertical steel columns 5 through four fasteners 14 for the connecting piece in such a way that each of four corners of the connecting piece 11 is fixed to one of the four fasteners 14 for the connecting piece, except for in the reserved door installation area 33 and the reserved window installation area 44, until the connecting pieces 11 are installed in all space limited by the adjacent vertical steel columns 5 and the horizontal steel columns 6.

Particularly:

A fastener 14 for the connecting piece is installed at each of lower ends of two adjacent vertical steel columns 5 by connecting fixing steel bars 17 of the fastener 14 to the vertical steel columns 5.

The connecting piece 11 is placed on the two installed fasteners 14 for the connecting piece, so that the chamfers 12 of the connecting piece 11 are in contact with the slopes 16 of the installed fasteners 14 for the connecting piece.

Likewise, two additional fasteners 14 for the connecting piece are placed on the connecting piece 11 and are connected with the two adjacent vertical steel columns 5, so that the chamfers 12 at the four corners of the connecting piece 11 are respectively in contact with the slopes 16 of the fasteners 14 for the connecting piece at the four corners, and are limited by the slopes 16 and ends 15 of the fasteners 14 for the connecting piece, thus the fixing of the bottommost connecting piece 11 to the vertical steel columns 5 is completed.

Subsequently, on the top of the installed connecting piece 11, the assembling of another four fasteners 14 for the connecting piece and another connecting piece 11 is similarly repeated between the two adjacent vertical steel columns 5, until the connecting pieces 11 are installed in all the space limited between the two adjacent vertical steel columns 5 and the upper and lower horizontal steel columns 6.

Then, the above assembling operations are repeated to install connecting pieces 11 in the space limited between another two adjacent vertical steel columns 5 and the upper and lower horizontal steel columns 6.

Step 5: steel mesh members 7 are respectively fixed on both internal and external sides of the vertical steel columns 5 and the horizontal steel columns 6 through jointing steel bars, resulting in a truss body formed by the steel mesh members 7, the vertical steel columns 5 and the horizontal steel columns 6.

Step 6: wall panels 20 are arranged on both the internal and external sides of the vertical steel columns 5 and the horizontal steel columns 6, and bolts are adopted to sequentially extend through the wall panel at one side, the connecting piece, and the wall panel at the other side to fix the same to the truss body together, where the bolts extend through the through holes 21 in the wall panels 20 and the through holes 13 in the connecting pieces 11.

Step 7: the first roof truss beams 8 and the second roof truss beams 9 are perpendicularly connected to form a grid-shaped spatial truss, which is the network system for bearing tension in the floor 2.

Step 8: the roof bottom dies 19 are fixed at the bottoms of the first roof truss beams 8 and the second roof truss beams 9 to form a roof cellular structure.

Step 9: the seams of the housing (between the various components) are filled to prevent the leakage of the cast high-strength self-compacting fluid mortar.

Step 10: the wall 1 and the floor 2 are integrally cast by a one-time cast molding process, to connect the tendon like system, the narrow like system and the skin like system together, so that a bearing layer having a composite steel net cement multilayer structure is formed.

Based on the above technical scheme, specific steps of the integrally casting include: the high-strength self-compacting fluid mortar are transferred to corners of each room at the same floor through the main pipe and branch pipes for the purpose of simultaneous casting at different spots, to ensure that each wall at the whole floor of the building can be uniformly cast.

The speed of the integrally casting is controlled according to parameters including: the increased height of the cast mortar per hour that is no more than 30 cm, and it is ensured that the lateral pressure of the cast mortar during the casting is within an allowable safe range.

Based on the above technical scheme, in the case that the housing body includes two or more stories, before the arrangement of the wall panels 20 in step 6, vertical steel columns 5 for an upper story are fixed at the top of the vertical steel columns 5 for a lower story using jointing steel bars, and steps 2 to 5 are repeated to complete a steel truss for the upper story and the connections of fasteners 14 for the connecting piece and connecting pieces 11, subsequently steps 6 to 10 for the construction of the wall and floor for the lower story are performed.

The construction sequence of the fully assembled and integrally cast composite housing and the construction method thereof is substantially different from the construction sequence of the existing building architecture, i.e. the construction of the main load bearing structure (including connections by steel bars, supporting for casting plates, casting of concrete, and maintenance) is performed before the construction of inner insulation wall, thermal insulation layers and decoration layers according to the construction sequence of the existing building architecture. However, according to the construction sequence of the fully assembled and integrally cast composite housing and the construction method thereof, the outlines of the building (including for example a thermal insulation layers, a fire resistance layer and a decoration layer) are established before the load bearing layer is constructed by casting. Thus, the thermal insulation layers, the fire resistance layer and the decoration layer may be attached to the building structure by mechanical connections and adherent material, and will not likely be released subsequently. Further, the casting plates and the corresponding auxiliary support members are not necessary for the building construction. In this way, the construction of the entire house includes: design, member dividing, and connections, where members divided from each system may be manufactured in a factory mechanically and then are assembled to form a building. The building may be constructed at site. Finally, the integrally casting is performed to obtain an integral building with wall and floor formed by composite materials, then the site is cleaned and the built building housing is handed over.

Some contents not described in detail herein are well-known by those skilled in the art.

The invention claimed is:

1. A fully assembled and integrally cast composite housing comprising at least one layer of housing body established on a housing foundation, the housing body including a wall (1), a floor (2), a door (3) and a window (4), wherein each story of the housing body is constructed of a tendon system, a marrow system, a skin system and a bone system, each of which includes one or more components, and wherein, the tendon system is a network system for bearing a tension within the wall (1) and the floor (2), and the network system includes: vertical steel columns (5), horizontal steel columns (6), a steel mesh member (7), a first roof truss beam (8) and a second roof truss beam (9), wherein space in the wall (1) is reserved for installation of the door (3) and the window (4);

the marrow system is configured to fix the network system bearing the tension within the wall (1) and floor (2) and connect the components in the tendon system and the skin system, and include a connecting piece (11), a fastener (14) for the connecting piece (11) and a roof bottom die (19);

the skin system, which includes wall panels (20), forms an external thermal insulation layer and an inner fire resistance layer for the wall (1), and functions as a casting plate and support system in connecting the tendon system, the marrow system and the skin system together through the bone system by a one-time cast molding process; and the bone system forms a bearing system in the wall (1) and the floor (2), is constructed by the one-time cast molding of the wall (1) and the floor (2) with high-strength self-compacting fluid mortar by an integrally casting process, and is configured to connect the tendon system, the marrow system and the skin system together, to form a load bearing layer having a steel mesh member and cement composite multilayer structure;

wherein the network system for bearing tension in the wall (1) includes: a steel truss constructed by connecting the vertical steel columns (5) with the horizontal steel columns (6), wherein the vertical steel column (5) acts as a support column of the wall (1), and the horizontal steel column (6) acts as a ground beam or upper ring beam, a distance between axes of adjacent vertical steel columns (5) is in a range from 15 cm to 60 cm, wherein 1 inch is equal to 2.54 cm;

upper and lower ends of the vertical steel column (5) are respectively connected with the horizontal steel columns (6) acting as the upper ring beam and the ground beam through jointing steel bars, the horizontal steel columns (6) acting as the ground beams are fixed to the housing foundation through the jointing steel bars, a second door or window, a reserved door installation area (33) or reserved window installation area (44) is formed by perpendicularly connecting the vertical steel columns (5) with the horizontal steel columns (6), steel mesh members (7) are fixed at both internal and external sides of the vertical steel columns (5) and both internal and external sides of the horizontal steel columns (6) through the jointing steel bars, the network system for bearing tension in the floor (2) includes: a number of parallel second roof truss beams (9), wherein the second roof truss beam (9) is provided with at least one opening (10) through which the first roof truss beam (8) passes through, and a number of the first roof truss beams (8) pass through corresponding said openings (10) in the second roof truss beams (9), and are perpendicularly connected with the second roof truss beams (9) to form a grid-shaped network system;

wherein the connecting piece (11) has a rectangular shape with chamfers (12) at four corners of the connecting piece (11), and at least four connecting through holes (13) for receiving bolts in the connecting piece (11), the fastener (14) for the connecting piece has an elongated shape, and has a same length as a width of the vertical steel column (5); one of two opposite sides of the fastener (14) along a length direction of the fastener (14) is provided with a plurality of fixing steel bars (17), and a second of the two opposite sides is provided with a slope (16) in a middle, wherein the slope (16) has a width matching with a width of the chamfer (12) located on the connecting piece, and every four fasteners (14) for the connecting piece are arranged in a rectangular shape on two adjacent vertical steel columns (5), and are fixed on the two adjacent vertical steel columns (5) according to a height of the connecting piece (11); each of the slopes (16) on the four fasteners (14) for the connecting piece is configured for fixing one corner of the connecting piece (11), the chamfers (12) at the four corners of the connecting piece (11) are respectively in contact with the slopes (16) of the four fasteners (14) for the connecting piece and are limited by the slopes (16) and ends (15) of the fasteners (14) for the connecting piece, so that the connecting piece (11) is fixed on the vertical steel columns (5).

2. The fully assembled and integrally cast composite housing of claim 1, wherein after the first roof truss beams (8) are perpendicularly connected with the second roof truss beams (9) to form the grid-shaped network system for bearing tension in the floor (2), the roof bottom dies (19) are fixed at bottoms of the first roof truss beams (8) and the second roof truss beams (9) to form a roof cellular structure.

3. The fully assembled and integrally cast composite housing of claim 1, wherein at least four through holes (21) for receiving bolts are formed in the wall panel (20), the wall panels (20) are respectively arranged on the steel mesh members (7) at both the internal and external sides of the vertical steel columns (5) and the horizontal steel columns (6), and bolts are adopted to extend through the through holes (21) in the wall panels and the through holes (13) in the connecting pieces (11), so that the connecting pieces (11) and the wall panels (20) at both the internal and external sides of the connecting pieces (11) are connected together.

4. The fully assembled and integrally cast composite housing of claim 1, wherein the connecting piece (11) and the wall panel (20) are foam concrete blocks, which are formed of cement added with fly ash.

5. The fully assembled and integrally cast composite housing of claim 1, wherein the high-strength self-compacting fluid mortar meets the following parameters that:

slump thereof is more than 28 cm, and decays to zero in about 1 hour, fluidity thereof is maintained for 20 to 25 minutes, initial setting time thereof is 1.5 hours, and a strength selected from a group consisting of 30 MPa, 35 MPa, 40 Mpa, and 45 MPa depending on the sequence number of a story in the housing;

wherein 1 inch is equal to 2.54 cm.

* * * * *